US005176182A

United States Patent [19]

Froment et al.

[11] Patent Number: 5,176,182

[45] Date of Patent: Jan. 5, 1993

[54] SPRING SYSTEMS FOR WEAVING LOOM DOBBIES OF NEGATIVE TYPE

[75] Inventors: Jean-Paul Froment; André Fumex, both of Faverges, France

[73] Assignee: S.A. Des Etavkussenebts Satubli (France), Faverges, France

[21] Appl. No.: 812,007

[22] Filed: Dec. 23, 1991

[30] Foreign Application Priority Data

Jan. 4, 1991 [FR] France ..... 91 00174

[51] Int. Cl.[5] ..... D03C 13/00

[52] U.S. Cl. ..... 139/82; 139/88; 139/84

[58] Field of Search ..... 139/82, 88, 83, 84, 139/87, 89, 66 A, 75

[56] References Cited

U.S. PATENT DOCUMENTS 4,603,713 8/1986 Takada ..... 139/82

4,905,739 3/1990 Froment ..... 139/88 X

FOREIGN PATENT DOCUMENTS 3243355 10/1988 Japan ..... 139/82

*Primary Examiner*—Andrew M. Falik

*Attorney, Agent, or Firm*—Dowell & Dowell

[57] ABSTRACT

In a spring system for a dobby in a weaving loom, the mobile hooking element which is fixed to a cable for moving a heddle frame includes laterally spaced plates which are slidably engageable with plates of adjacent spring systems to thereby prevent contact of the springs of the adjacent spring systems.

5 Claims, 2 Drawing Sheets

SPRING SYSTEMS FOR WEAVING LOOM DOBBIES OF NEGATIVE TYPE

FIELD OF THE INVENTION

1. Background of the Invention

The present invention relates to dobbies and other weaving mechanisms of the negative type for forming the shed in weaving looms, and more particularly to the spring systems which, in this type of mechanism, ensure return of the heddle frames maneuvered with the aid of the springs.

2. History of the Related Art

Mechanisms of the negative type are known to operate positive control of the heddle frames effectively only in one direction of the reciprocating stroke thereof, so that elastic elements should be provided, arranged so as to effect return of the frames to the other end of the stroke. These elastic elements most often include two systems formed by parallel springs retained between two hooking elements of which, one is mounted permanently on a console or rack secured to the structure of the loom, while the other is hooked to the end of one of the cables provided for maneuvering each frame.

It will be readily appreciated that the springs of each spring system are thus in tension during positive control of the frame by the dobby or other mechanism (which control is effected most often upon lowering), and, by elastic traction on the corresponding cable, returning the said frame to the initial position (upper position in the case in question).

It should be observed here that the forces furnished by the spring systems are significant, at least when they are associated with heddle frames of considerable width for maneuvering very stiff layers of warp yarns, with the result that the cables tend to twist under the load of the springs. Now, any effect of twisting of the cables causes contacting and mutual friction of the mobile hooking elements of the group of spring systems mounted side by side on the same side of the assembly of frames and, especially, of the springs themselves. Such untimely contacts are the frequent cause of the springs breaking.

SUMMARY OF THE INVENTION

It is a principal object of the present invention to overcome the aforementioned drawback by providing a spring system for dobbies and other weaving mechanisms of the negative type, including a series of springs stretched between a fixed hooking element and a mobile hooking element attached to the end of a cable for manuevering a heddle frame wherein the ends of the hooking element are equipped with plates which extend parallel to the springs and whose thickness is slightly greater than the diameter of the springs in order that the contiguous plates of two adjacent hooking elements can rub against one another thereby preventing any contact between the springs which are associated therewith.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
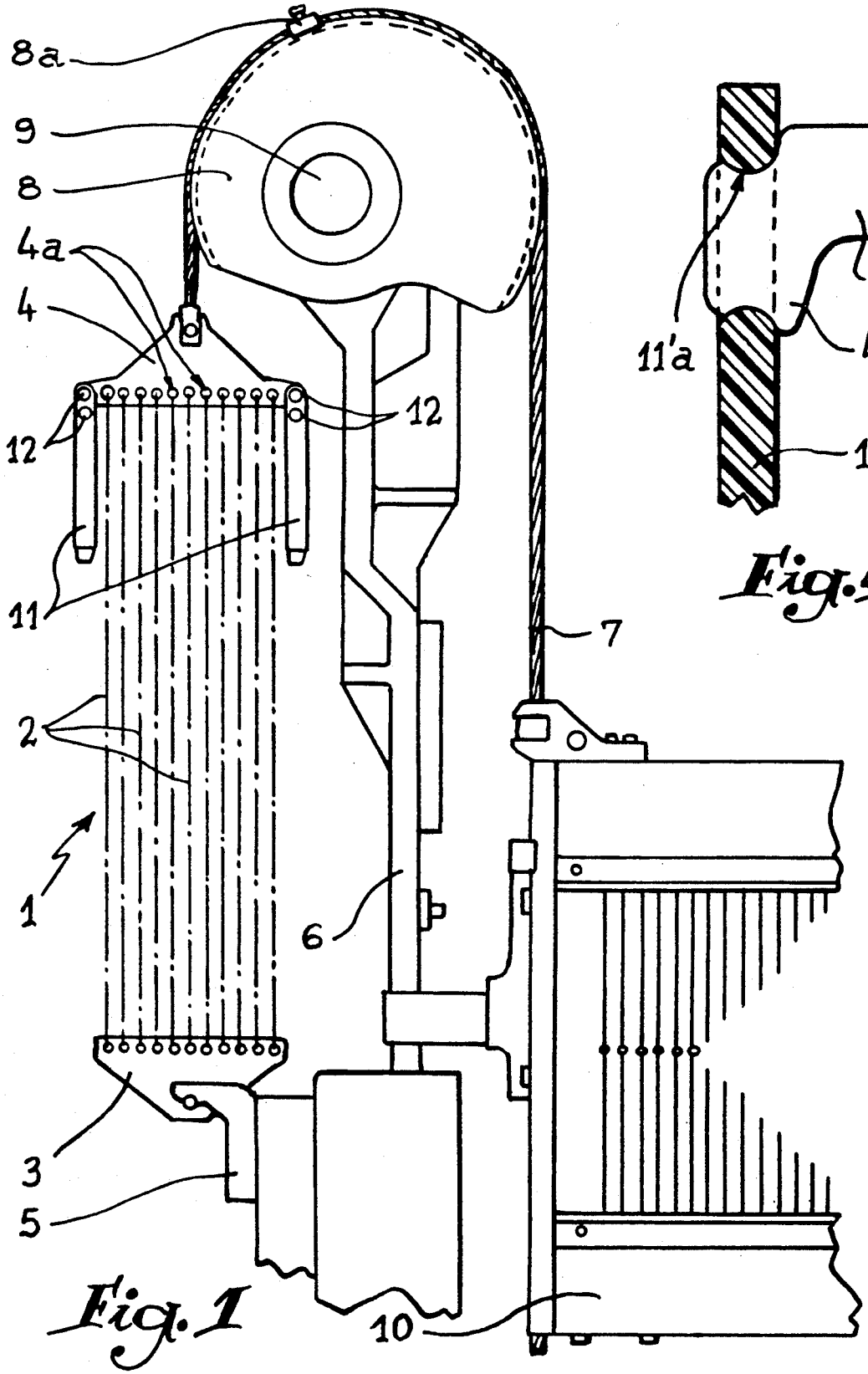
FIG. 1 is a schematic view in elevation, showing the arrangement of a spring system according to the invention.

Referring now to the drawings, the spring system referenced 1 in FIG. 1 comprises a series or layer of springs 2 hooked vertically between two hooking elements 3 and 4. The lower hooking element 3 of each spring system is fixed to a rack 5 secured to the vertical structure 6 of the weaving loom, while the upper hooking element 4, which is moveable is attached to a cable 7. The cable is connected at 8*a* to a guide lever 8 mounted to oscillate on a shaft 9 carried by the structure 6, and it is laterally secured to a heddle frame 10 before hooking to the corresponding moveable member of a dobby or other mechanism of the negative type.

Figure 2:
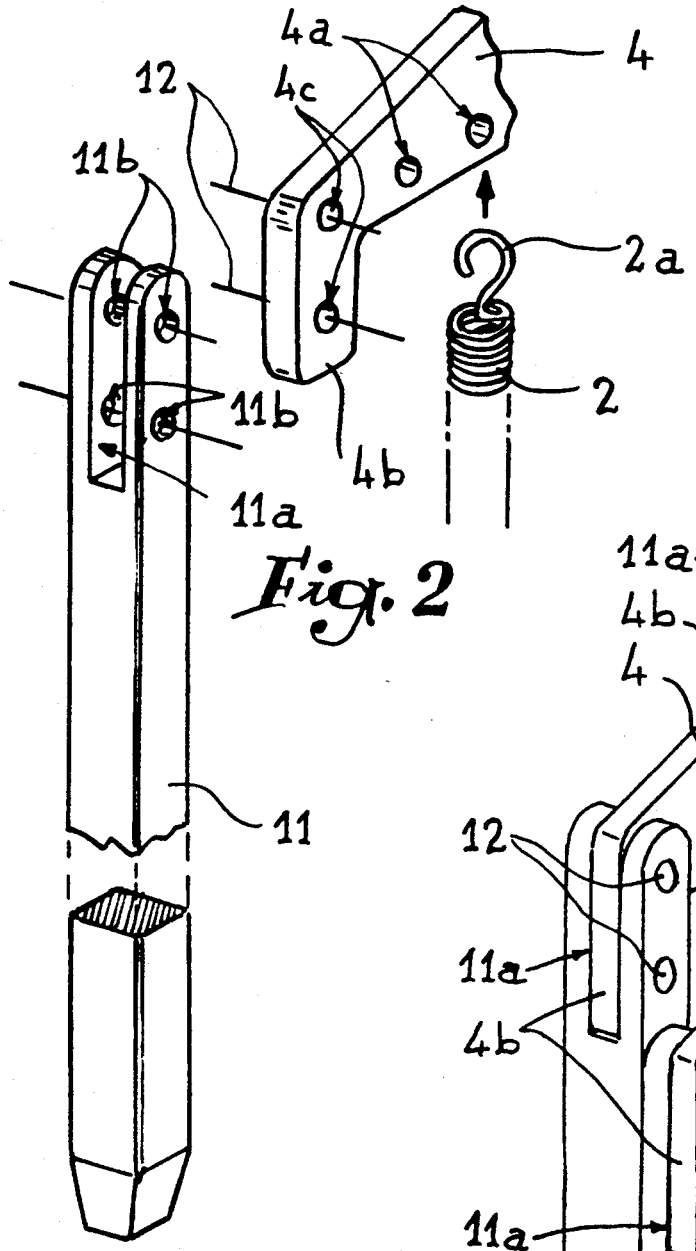
FIG. 2 illustrates in perspective the assembly of one of the two lateral plates of the spring system of FIG. 1.
Figure 3:
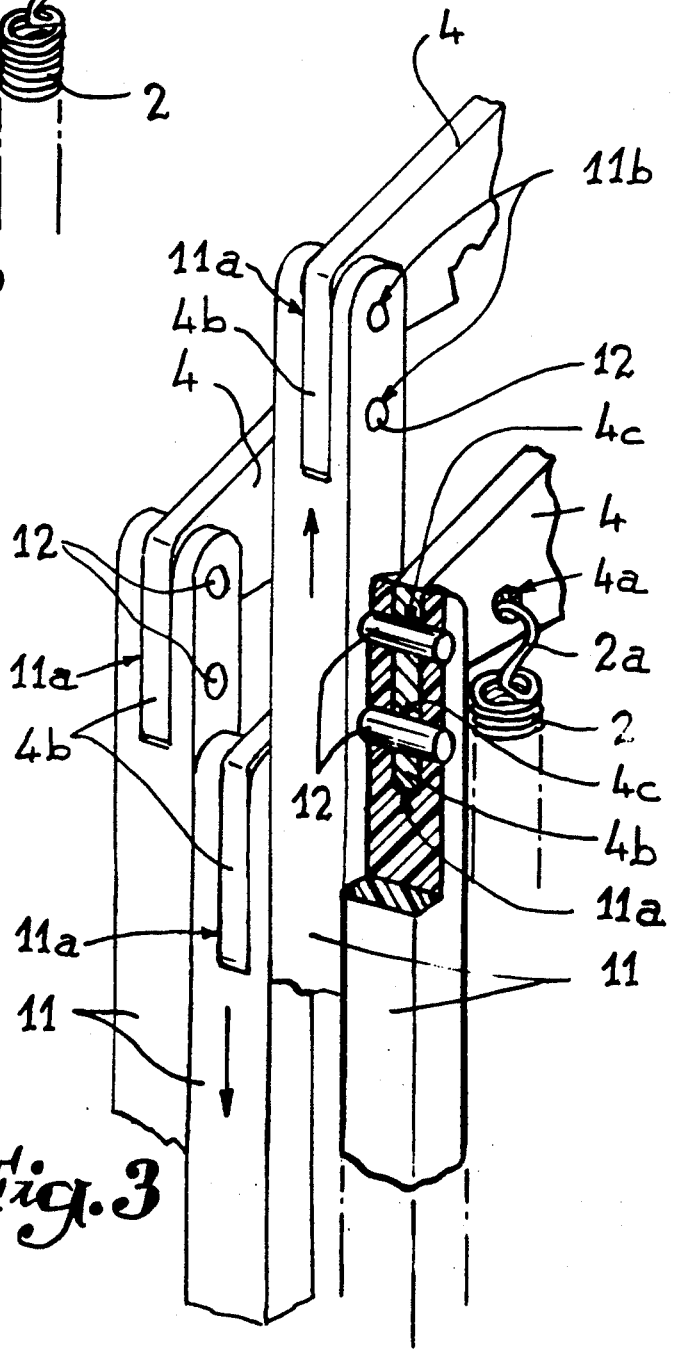
FIG. 3 shows, with parts vertically broken away, the guiding ensured by the plates of four contiguous spring systems.

According to the invention and as illustrated more particularly in FIGS. 2 and 3, the upper hooking element 4 comprises at each of its ends, beyond the series of openings 4*a* intended for hooking the bent end 2*a* of the springs 2, a vertical flange 4*b* having two holes 4*c* therein. Each flange 4*b* is adapted to be engaged vertically in the upper forked end 11*a* of a plate 11. The plate is fixed in place with the aid of two rivets 12 introduced in the above-mentioned holes 4*c* and in corresponding holes 11*b* made in the forked end 11*a* of the plate 11.

Plates 11 are made of a synthetic material having a low coefficient of friction to promote sliding contact and has a thickness slightly greater than the diameter of the springs 2, so that, as shown in FIG. 3, the lateral faces thereof come into contact with the lateral faces of the plates of the contiguous spring systems.

Under these conditions, it will be readily appreciated that plates 11 of the assembly of spring systems 1 ensure guiding of the moveable hooking elements 4 during the reciprocating vertical displacements of frames 10 of the loom, consequently opposing the effects of twisting of the cables and preventing any untimely contact of the springs 2 of two adjacent spring systems.

Tests have shown that, by adopting plates 11, the frequency of accidental breakage of springs 2 of the different systems 1 of a weaving loom, is substantially reduced.

Figure 4:
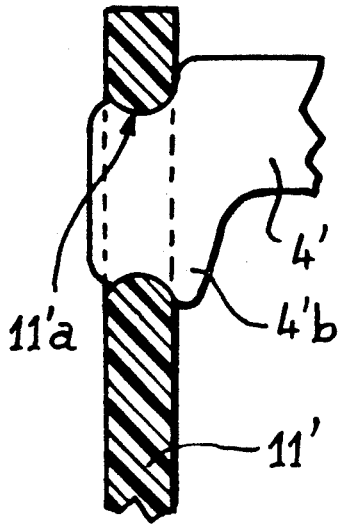
FIG. 4 illustrates a variant mode of fixing the plates on the hooking elements.

The height of each plate 11 may vary to a large extent, as a function in particular of the amplitude of the stroke of the spring systems. Furthermore, any other mode of fixing plates 11 on the ends of the moveable hooking elements may be used, particularly the one illustrated in FIG. 4 where it has been assumed that the flange 4'*b* of the hooking element 4' is sectioned so as to clip elastically inside a corresponding opening 11'*a* provided in the upper end of each plate 11'.

What is claimed is:

1. In a spring system for weaving mechanisms of the negative type which include a heddle frame moved by a cable attached to a moveable hooking element and wherein a plurality of springs are mounted between the moveable hooking element and a fixed hooking element, and wherein the springs have a first cross-sectional diameter, the improvement comprising, the moveable hooking element having opposite end portions extending outwardly of the springs, a plate means mounted to said end portions of the moveable hooking element, and said plate means extending generally parallel to the springs and having a thickness which is greater than the diameter of the springs whereby, plate means of adjacent spring systems can contact one another to thereby prevent contact between the springs of the adjacent spring systems.

2. The improvement for a spring system of claim 1 in which each of said plate means is formed of a synthetic material having a low coefficient of friction.

3. The improvement for a spring system of claim 2 wherein said springs are aligned between said plate means mounted to said opposite end portions of said moveable hooking element.

4. The improvement for a spring system of claim 1 in which each of said plate means includes an upper forked end portion, said end portions of said moveable hooking element having depending flanges and means for securing said dependent flanges of each of said end portions of said hooking element within said forked end portions of said plate means.

5. The improvement for a spring system of claim 1 wherein each of said plate means includes an upper end portion having an opening adjacent thereto, said end portions of said moveable hooking element being receivable within said openings of said plate means.

* * * * *